US011259618B1

(12) United States Patent
Feterman

(10) Patent No.: US 11,259,618 B1
(45) Date of Patent: Mar. 1, 2022

(54) LIQUID DISPENSING CONTAINER ASSEMBLY

(71) Applicant: Gerardo Feterman, Bay Harbor Islands, FL (US)

(72) Inventor: Gerardo Feterman, Bay Harbor Islands, FL (US)

(73) Assignee: Inventos, LLC, North Miami, FL (US)

( * ) Notice: Subject to any disclaimer, the term of this patent is extended or adjusted under 35 U.S.C. 154(b) by 0 days.

(21) Appl. No.: 17/104,935

(22) Filed: Nov. 25, 2020

Related U.S. Application Data

(60) Provisional application No. 62/941,364, filed on Nov. 27, 2019.

(51) Int. Cl.

| | |
|---|---|
| ***A45D 34/04*** | (2006.01) |
| ***A45D 40/26*** | (2006.01) |
| ***B05C 17/02*** | (2006.01) |
| ***B05C 17/03*** | (2006.01) |

(52) U.S. Cl.
CPC ..... *A45D 34/041* (2013.01); *A45D 40/261* (2013.01); *B05C 17/02* (2013.01); *B05C 17/0227* (2013.01); *B05C 17/03* (2013.01)

(58) Field of Classification Search
CPC ..... A45D 34/041; A45D 34/04; A45D 40/26; A45D 40/261; B05C 17/02; B05C 17/022; B05C 17/0227; B05C 17/03; B05C 17/0316
USPC ..... 401/28, 208, 209, 216, 219
See application file for complete search history.

(56) References Cited

U.S. PATENT DOCUMENTS

| | | | | | |
|---|---|---|---|---|---|
| 2,103,261 | A * | 12/1937 | Hughes | A45D 34/041 | 601/154 |
| 2,702,396 | A * | 2/1955 | Straszer | A46B 11/0013 | 401/281 |
| 3,390,941 | A * | 7/1968 | Weber | A47L 23/05 | 401/205 |
| 3,994,290 | A * | 11/1976 | Springer | A61H 15/02 | 601/131 |
| 4,811,726 | A * | 3/1989 | Goncalves | A45D 34/041 | 222/521 |
| 5,131,384 | A * | 7/1992 | Obagi | A61H 15/02 | 401/28 |
| 6,244,776 | B1 * | 6/2001 | Wiley | B05C 17/0205 | 401/183 |

(Continued)

*Primary Examiner* — David J Walczak
(74) *Attorney, Agent, or Firm* — John Rizvi; John Rizvi, P.A.—The Patent Professor®

(57) ABSTRACT

A liquid dispensing container assembly includes a container having a container interior configured to contain a supply of liquid to be dispensed. A rotatable, liquid dispensing head is carried by the container and has a dispensing surface and a dispensing port. An opening in the liquid dispensing head may communicate with the dispensing port. The liquid dispensing head includes one or more rollers disposed in one or more respective sockets. A dispensing adaptor may be disposed in the liquid dispensing head. The liquid dispensing head may be rotatable between a dispensing position wherein the opening in the liquid dispensing head aligns or registers with an opening in the dispensing adaptor to facilitate flow of the liquid from the container onto the dispensing surface of the liquid dispensing head and a closed position wherein the opening misaligns or misregisters with the opening in the dispensing adaptor.

19 Claims, 7 Drawing Sheets

(56) References Cited

U.S. PATENT DOCUMENTS 7,153,053 B1 * 12/2006 Wiley ..... A45D 34/041
401/219

* cited by examiner

LIQUID DISPENSING CONTAINER ASSEMBLY

CROSS-REFERENCE TO RELATED APPLICATION

This application claims the benefit of U.S. Provisional Patent Application No. 62/941,364, filed on Nov. 27, 2019, which is incorporated herein by reference in its entirety.

FIELD OF THE INVENTION

The present invention relates generally to dispensing devices, and more particularly, to a liquid dispensing container assembly having a liquid dispenser and a massage applicator.

BACKGROUND OF THE INVENTION

A variety of packages including roll-ons and dispensing packages or containers have been developed for personal care products such as shampoo, lotions and other fluid materials. Typically, these dispensers discharge the liquid substance from the container through a roller, which carries the liquid substance and applies the liquid substance on the user's skin. The substance, however, continues to flow from the container around the roller after the desired quantity of the substance has been dispensed, thus oversupplying the substance.

Another disadvantage of many conventional applicator dispensers is that the liquid content directly contacts the roller as it is dispensed from the container. There is therefore a potential risk that contaminants outside the container will contaminate the substance as it is dispensed.

Some conventional dispensers may include a valve through which the substance is dispensed. However, spreading of the substance on the skin of the user must be carried out by hand.

Accordingly, there is an established need for a solution to at least one of the aforementioned problems, and/or for further improvements to liquid substance dispensers of the type that are designed to dispense and apply a liquid substance onto a user's skin.

SUMMARY OF THE INVENTION

The present invention is directed to a liquid dispensing container assembly having a liquid dispenser and a massage applicator. The liquid dispensing container assembly may include a container. A supply of cream or other liquid to be dispensed may be placed in the container. A liquid dispensing head may be provided on the container. A dispensing adaptor may be disposed between the container and the liquid dispensing head. The liquid dispensing head may be conveniently rotated to open/close fluid communication from inside the container. At least one roller socket may extend into the liquid dispensing head. At least one massage roller may be disposed in the roller socket. Accordingly, the massage rollers may be applied to the skin of a user or other surface as the liquid is discharged through the liquid dispensing head to spread the liquid on the skin or surface.

In a first implementation, a liquid dispensing container assembly may include a container having a container interior configured to contain a supply of liquid, and a container opening in fluid communication with the container interior. A dispensing adaptor may be secured to the container; the dispensing adaptor may be fitted over and enclose the container opening. The dispensing adaptor may include a port in fluid communication with the container opening, and may further include a first adaptor wall having a first opening. The liquid dispensing container assembly may further include a liquid dispensing head carried by the container. The liquid dispensing head may include a dispensing head interior and a first liquid dispensing head wall portion having a second opening. The liquid dispensing head may be positioned over the dispensing adaptor with the dispensing adaptor received in the dispending head interior and the first adaptor wall and first dispensing head wall portion rotationally fitted one into the other to confine fluid therein. The liquid dispensing head may further include a dispensing side, a dispensing port on the dispensing side, at least one roller socket formed on the dispensing side, and at least one massage roller, wherein each massage roller is disposed in a respective roller socket. The liquid dispensing head may be rotatable with respect to the dispensing adaptor, and may be configured to rotationally adopt a dispensing position in which the second opening aligns with the first opening, and fluid communication is provided from the container interior, through the container opening, through the port of the dispensing adaptor, through the aligned first and second openings, and to the dispensing port of the liquid dispensing head.

In a second aspect, the liquid dispensing head may be configured to further rotationally adopt a closed position in which the second opening is not aligned with the first opening, thereby preventing fluid communication from the port of the dispensing adaptor to the dispensing port of the liquid dispensing head.

In another aspect, the first adaptor wall and the first liquid dispensing head wall portion may be cylindrical.

In another aspect, the first adaptor wall and the first liquid dispensing head wall portion may be arranged in concentric relationship with one another.

In another aspect, the first liquid dispensing head wall portion may be arranged radially outward of the first adaptor wall.

In yet another aspect, the dispensing adaptor may include a second adaptor wall arranged radially outward of and in concentric relationship with the first adaptor wall. The liquid dispensing head may further include a second liquid dispensing head wall portion arranged radially outward of and in concentric relationship with the first liquid dispensing head wall portion. The second adaptor wall and the second liquid dispensing head wall portion may be rotationally fitted one into the other.

In another aspect, the first and second adaptor walls and the first and second liquid dispensing head wall portions may be cylindrical.

In another aspect, the second liquid dispensing head wall portion may be arranged radially inward of the second adaptor wall.

In another aspect, the at least one roller socket may include a plurality of roller sockets, and the at least one massage roller may include a corresponding plurality of massage rollers, with each roller fitted into a respective socket.

In yet another aspect, the plurality of massage rollers may be arranged radially outward of the dispensing port.

In another aspect, the plurality of massage rollers may be disposed around the dispensing port.

In another aspect, respective outer sides of the plurality of massage rollers may be arranged along an imaginary surface forming an angle other than 90 degrees with a longitudinal axis of the container.

In another aspect, the dispensing side may form an angle other than 90 degrees with a longitudinal axis of the container.

In yet another aspect, the dispensing adaptor may include a radially outwardly protruding flange configured to rotationally clip onto the liquid dispensing head within the liquid dispensing head interior.

In another aspect, the container may further include a container neck arranged around the container opening. The dispensing adaptor may include an adaptor base, which may be clipped to the container neck.

In another aspect, the adaptor base may be arranged radially outward of and in concentric relationship with the container neck.

In another aspect, the adaptor base may further include an adaptor insert fitted inside the container neck. The adaptor insert and container neck may fluid-tightly enclose the container opening to direct all fluid from the container opening to the dispensing adaptor.

In yet another aspect, the container may include at least one rotation prevention flange configured to limit rotation of the dispensing adaptor.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, *background*, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a liquid dispensing container assembly having a liquid dispenser and a massage applicator.

Figure 4:
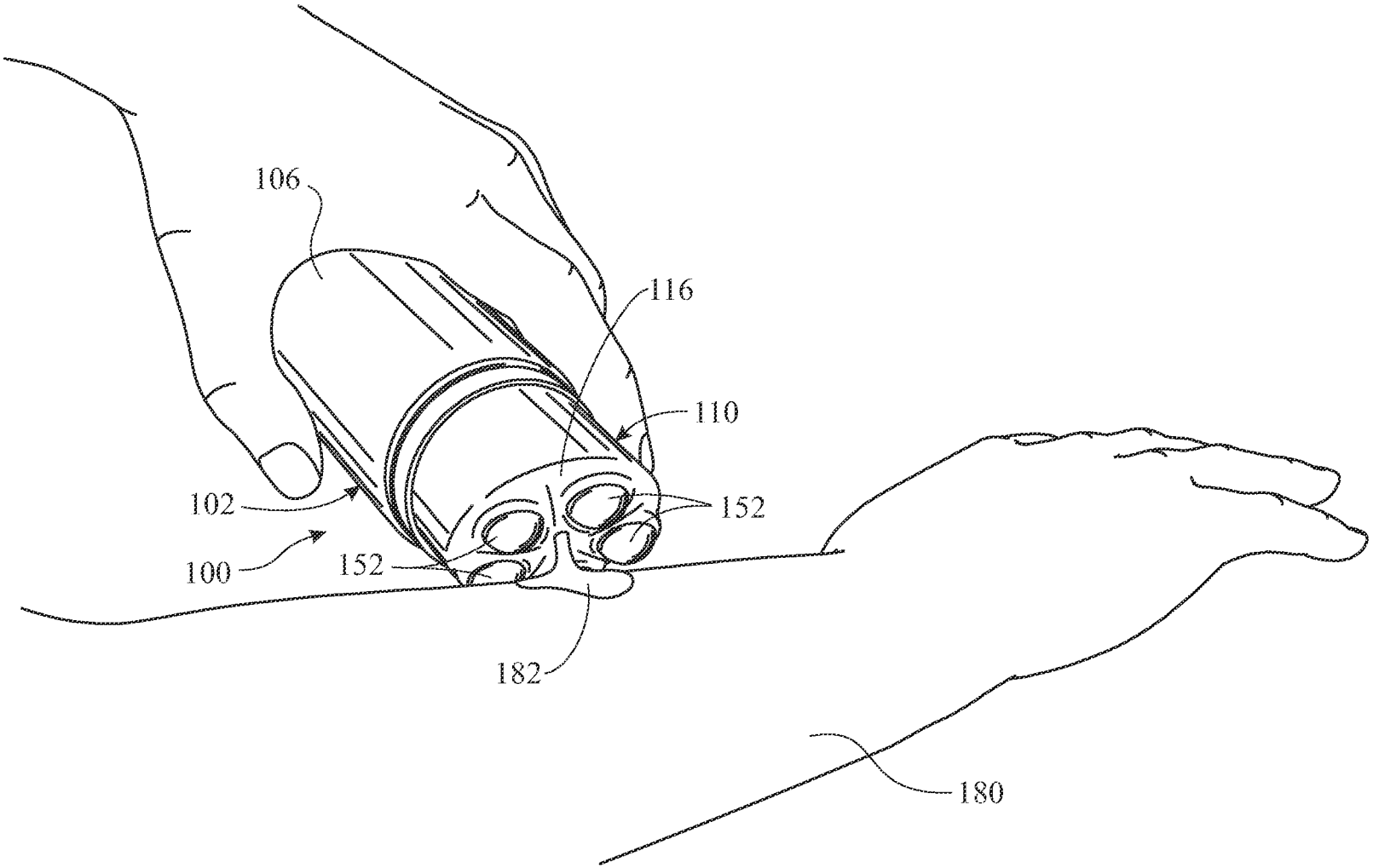
FIG. 4 presents a perspective view of the liquid dispensing container assembly in typical initial application of a liquid substance to the skin on the arm of a user.
Figure 5:
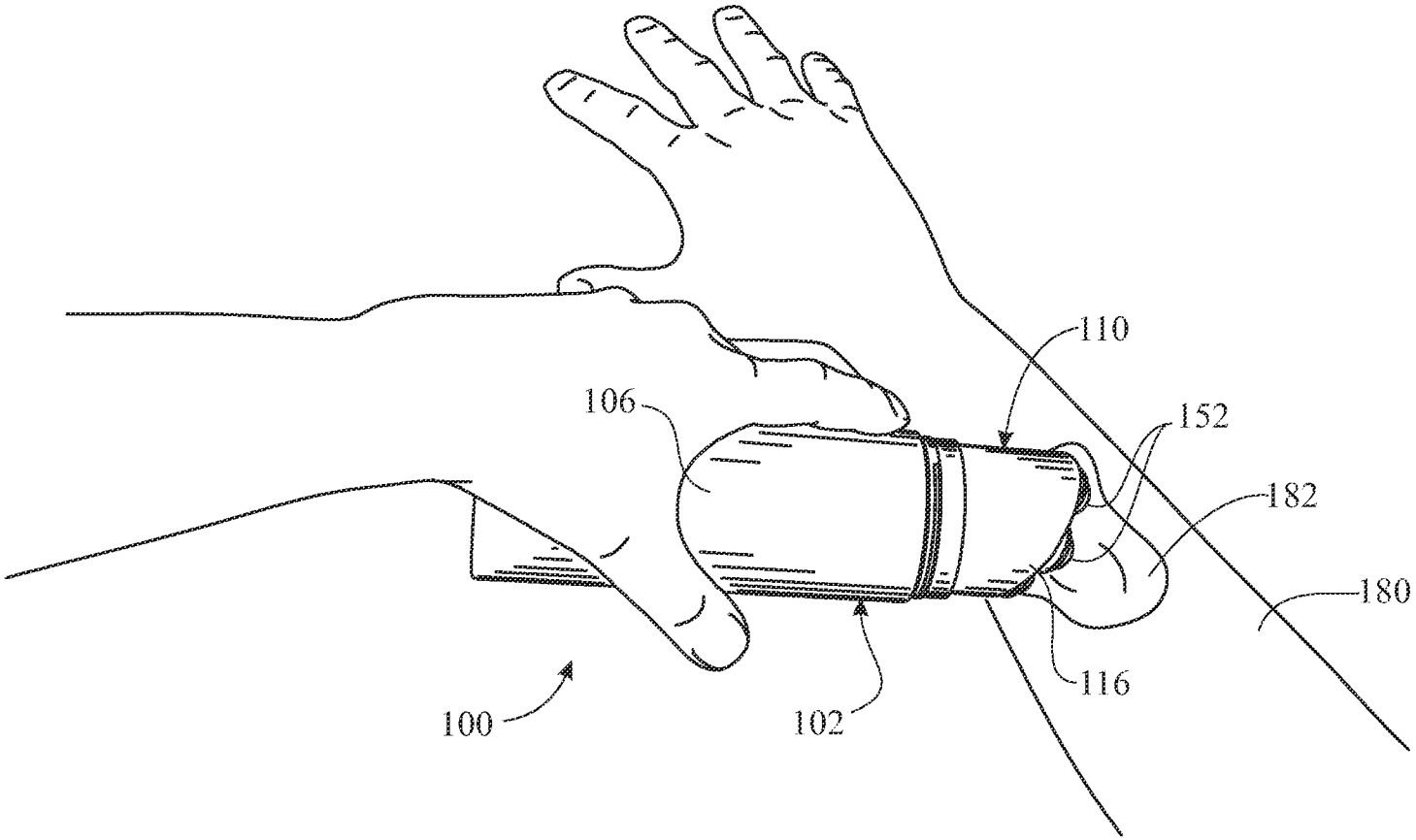
FIG. 5 presents a perspective view of the liquid dispensing container assembly in typical prolonged application of a liquid substance to the skin on the arm of the user.

Referring initially to FIGS. 4 and 5 of the drawings, an illustrative embodiment of the liquid dispensing container assembly is generally indicated by reference numeral 100. In an illustrative application, which will be hereinafter described, the liquid dispensing container assembly 100 may facilitate application of a flowable liquid substance 182 to a surface such as the skin on the arm 180 of a user, for example and without limitation. Non-limiting examples of liquid substances 182 which may be applied to the skin may include hand creams or lotions, suntan lotions, sunscreens, cosmetics, and deodorants. The liquid dispensing container assembly 100 may additionally facilitate effective spreading of the liquid substance 182 over the skin or other surface. The user can stop dispensing the liquid substance 182 from the liquid dispensing container assembly 100 at will to facilitate the desired quantity of the liquid substance 182 on the skin or other surface.

Figure 6:
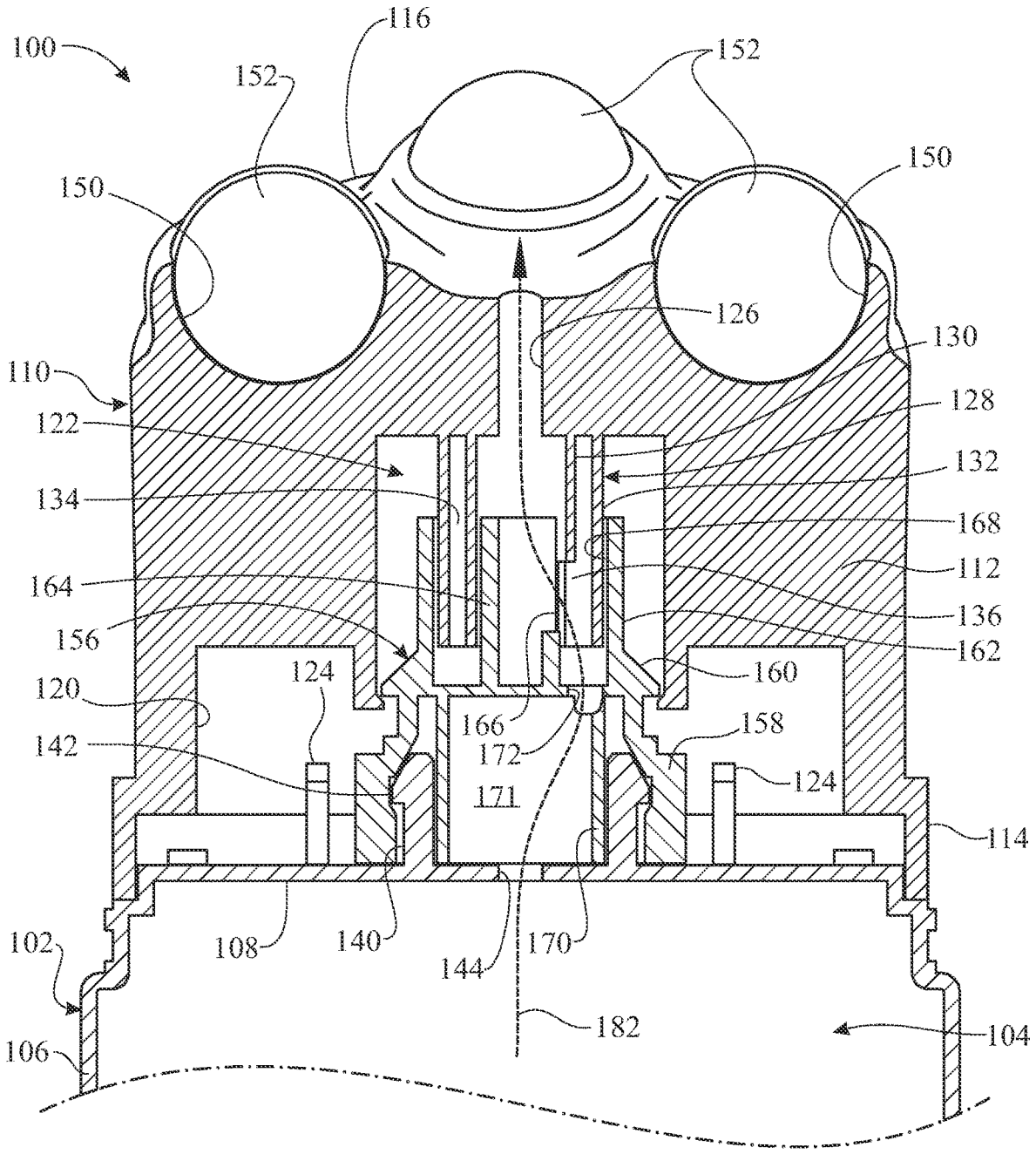
FIG. 6 presents a sectional view of the liquid dispensing head of the liquid dispensing container assembly, with the liquid dispensing head disposed in the dispensing position with respect to the dispensing adaptor, more particularly illustrating flow of a liquid substance from the container through the dispensing adaptor and the dispensing port, respectively, and onto the dispensing surface of the liquid dispensing head.
Figure 7:
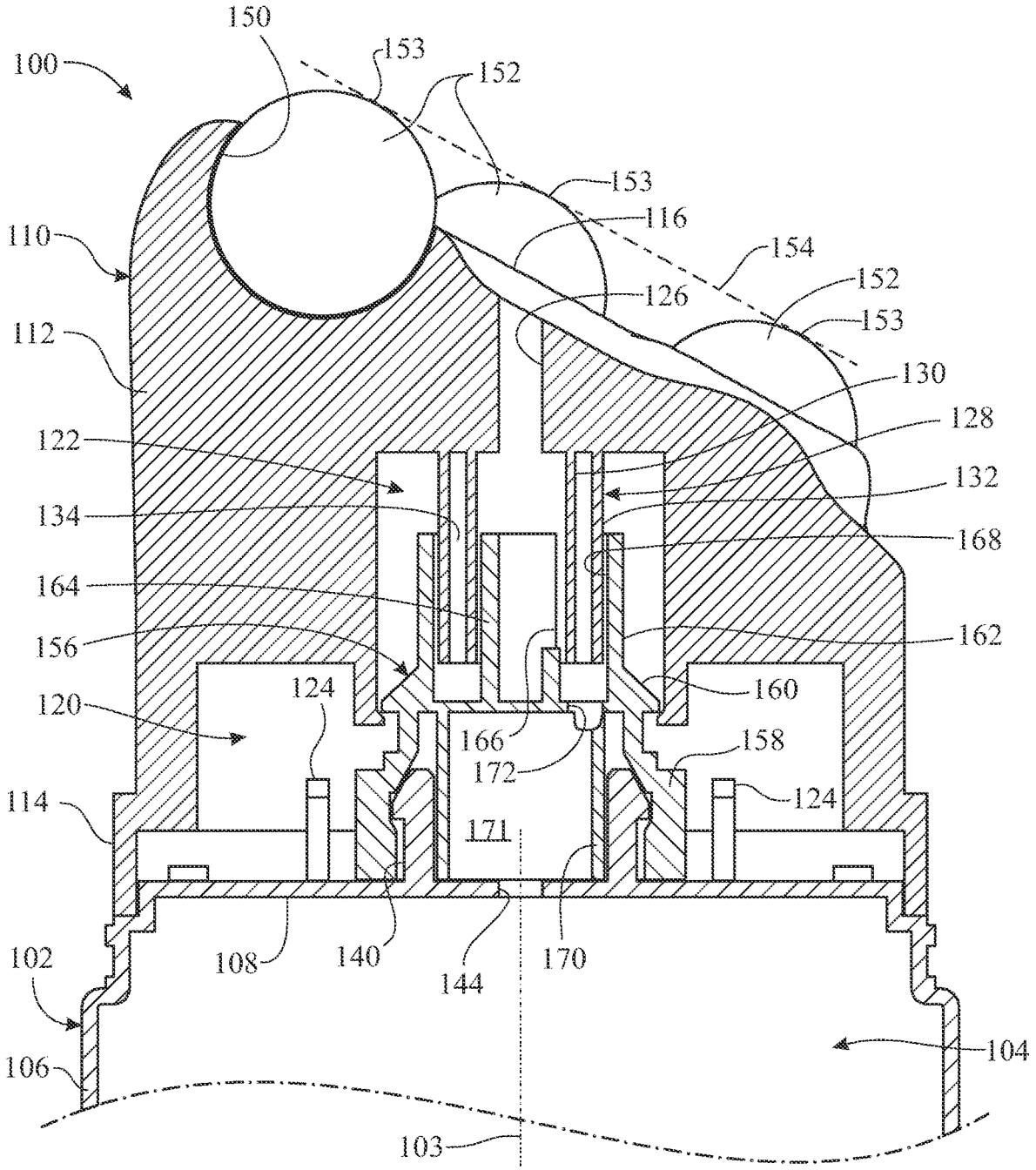
FIG. 7 presents a sectional view of the liquid dispensing head of the liquid dispensing container assembly, with the liquid dispensing head disposed in the closed position with respect to the dispensing adaptor.

Referring next to FIGS. 1-3, 6 and 7 of the drawings, the liquid dispensing container assembly 100 may include a container 102. The container 102 may have a container wall 106 which in some embodiments may be elongated and cylindrical, as illustrated. In other embodiments, the container wall 106 may have alternative shapes or configurations such as with a square, rectangular, triangular, polygonal, elliptical, or alternatively shaped cross-section. In some embodiments, the container 102 may be a squeezable container having a flexible container wall 106 fabricated of plastic and/or other flexible or resilient material. As illustrated in FIGS. 6 and 7, a container top 108 may close the top of the container wall 106. An interior space or container interior 104 may be formed or defined by, and between, the container wall 106 and the container top 108. A container neck 140 may extend from the container top 108, oppositely to the container wall 106; for example, in the present illustrations and orientation of the container 102, the container wall 106 and container neck 140 extend downward and upward, respectively, from the container top 108. An exterior circumscribing neck flange 142 may protrude radially outward from the container neck 140. A container opening 144 may extend through the container top 108 inside the container neck 140 for purposes which will be hereinafter described.

Figure 2:
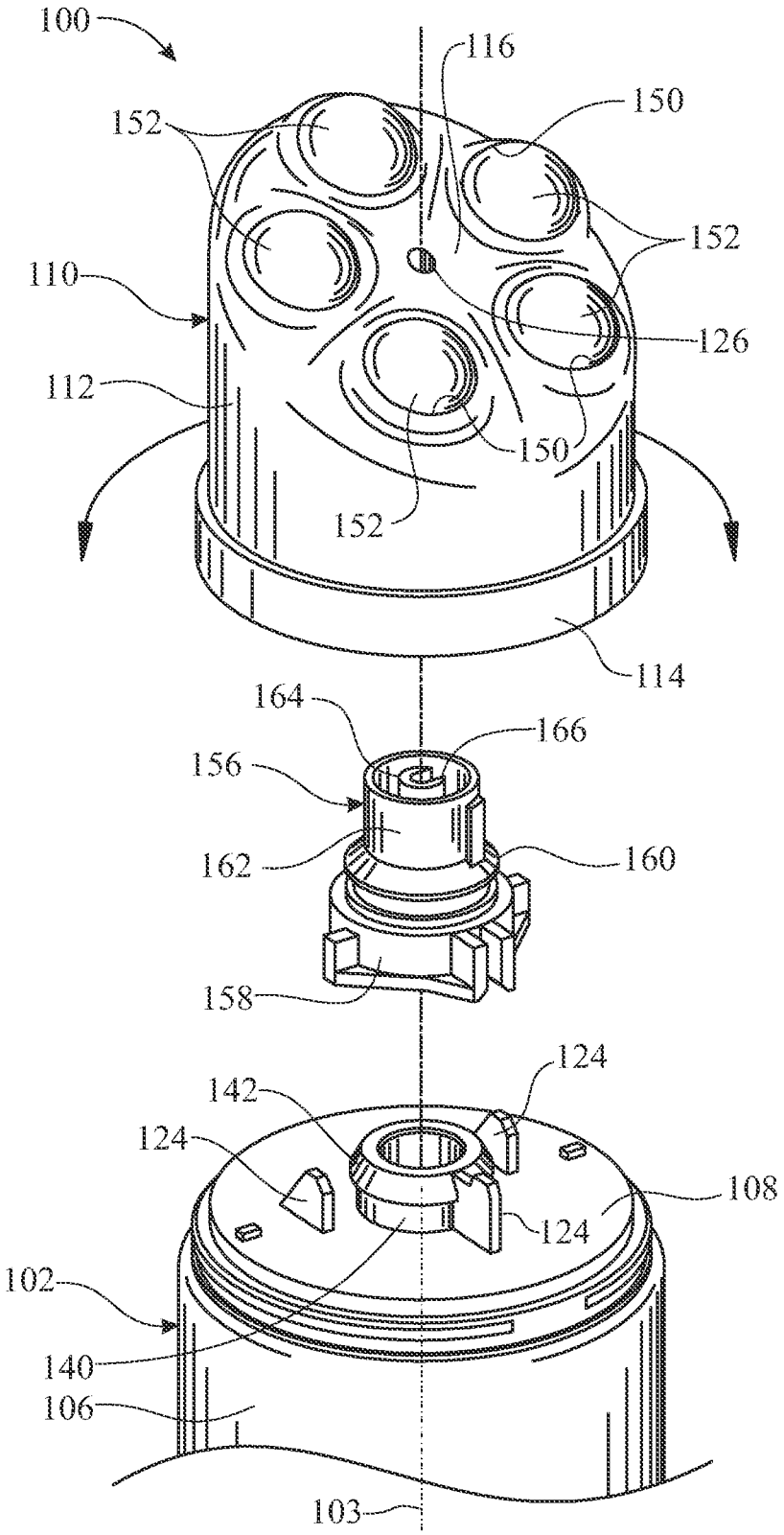
FIG. 2 presents an exploded top perspective view of the liquid dispensing container assembly of FIG. 1, more particularly illustrating typical placement of a dispensing adaptor in the liquid dispensing head and attachment of the liquid dispensing head to the container.
Figure 3:
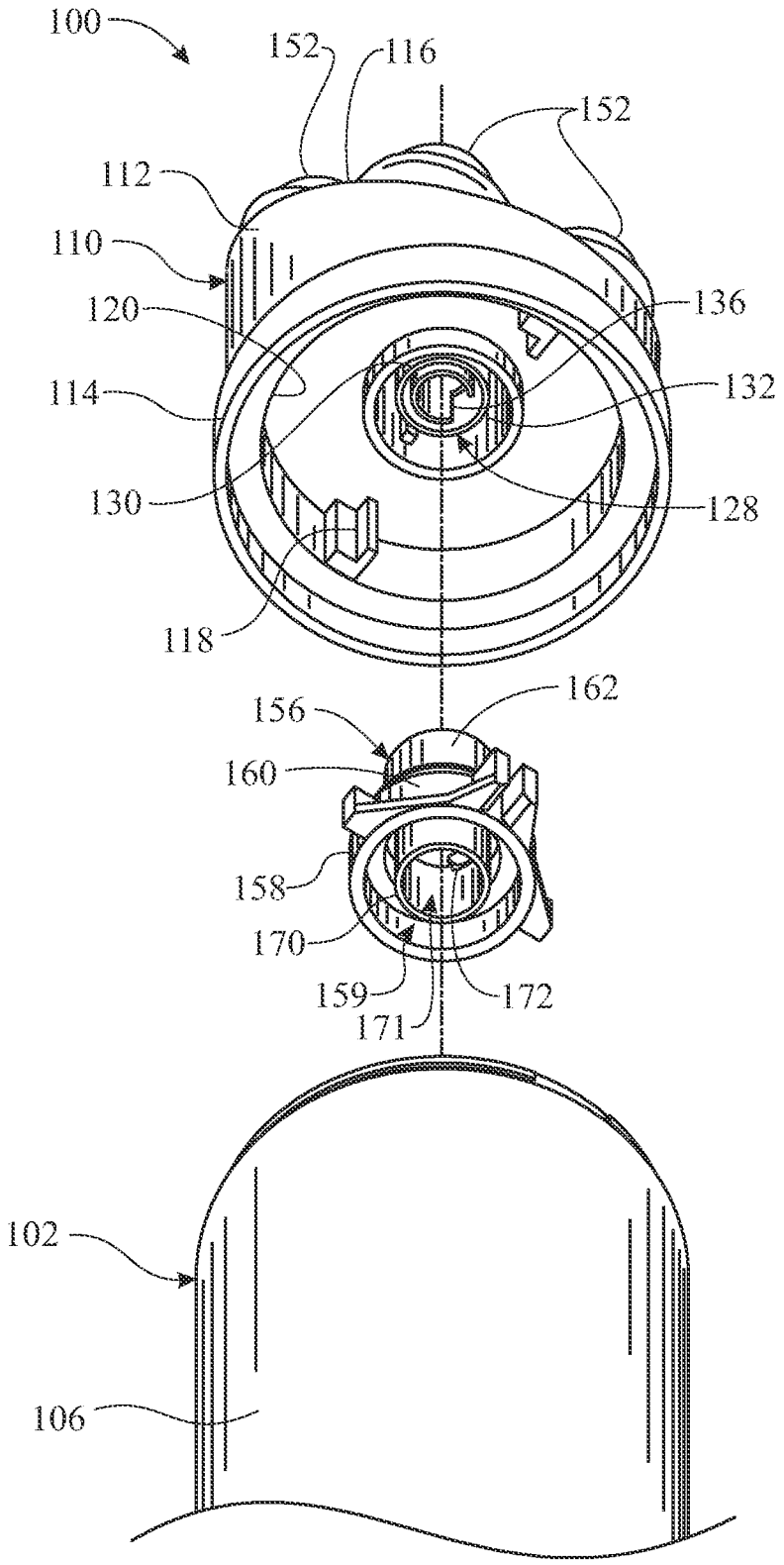
FIG. 3 presents an exploded bottom perspective view of the liquid dispensing container assembly of FIG. 1, more particularly illustrating typical placement of a dispensing adaptor in the liquid dispensing head and attachment of the liquid dispensing head to the container.

A rotatable liquid dispensing head 110 may be provided on the container 102. As illustrated in FIGS. 6 and 7, the liquid dispensing head 110 may include a dispensing head body 112. At least one dispensing port 126 may extend through the dispensing head body 112. In some embodiments, an attachment flange 114 may extend from the dispensing head body 112. As best shown in FIGS. 2 and 3, in some embodiments, the attachment flange 114 may extend along a full perimeter of the dispensing head body 112, providing a skirt to the dispensing head body 112. The attachment flange 114 may facilitate fixed or removable attachment of the dispensing head body 112 to the container 102.

As particularly illustrated in FIGS. 2 and 7, the liquid dispensing head 110 may have a dispensing face or surface 116 formed at a side of the liquid dispensing head 110, opposite to the side of the liquid dispensing head 110 which faces the container 102. For example, in the present embodiment, the dispensing surface 116 is arranged on a top side of the liquid dispensing head 110. In some embodiments, the dispensing surface 116 may be disposed at an angled or sloped orientation with respect to a longitudinal axis 103 of the container 102. At least one roller socket 150 may extend into the dispensing surface 116. At least one massage roller 152 may be disposed for rotation in each roller socket 150. In some embodiments, a plurality of massage rollers 152 may be disposed for rotation in a respective plurality of roller sockets 150 which may be arranged in a selected pattern on the dispensing surface 116. As best shown in FIG. 7, the plurality of massage rollers 152 may be arranged in a sloped formation, i.e. such that outer areas 153 are substantially arranged on an imaginary plane 154 or imaginary non-flat surface that generally forms an angle other than 90 degrees with the central longitudinal axis 103 of the container 102, i.e. is sloped relative to the central longitudinal axis 103. For example and without limitation, in some embodiments, a plurality of the massage rollers 152 may be arranged in spaced-apart relationship to the dispensing port 126 which may be at the center of the dispensing surface 116 such that the massage rollers 152 form a perimeter around the dispensing port 126. This geometrical relationship between the massage rollers 152 and the dispensing port 126 may enable the liquid substance 182 to uniformly reach all of the massage rollers 152 such as by, for example, circular movement of the massage rollers 152 against the skin of the user as the liquid substance 182 is dispensed from the dispensing port 126.

Figure 1:
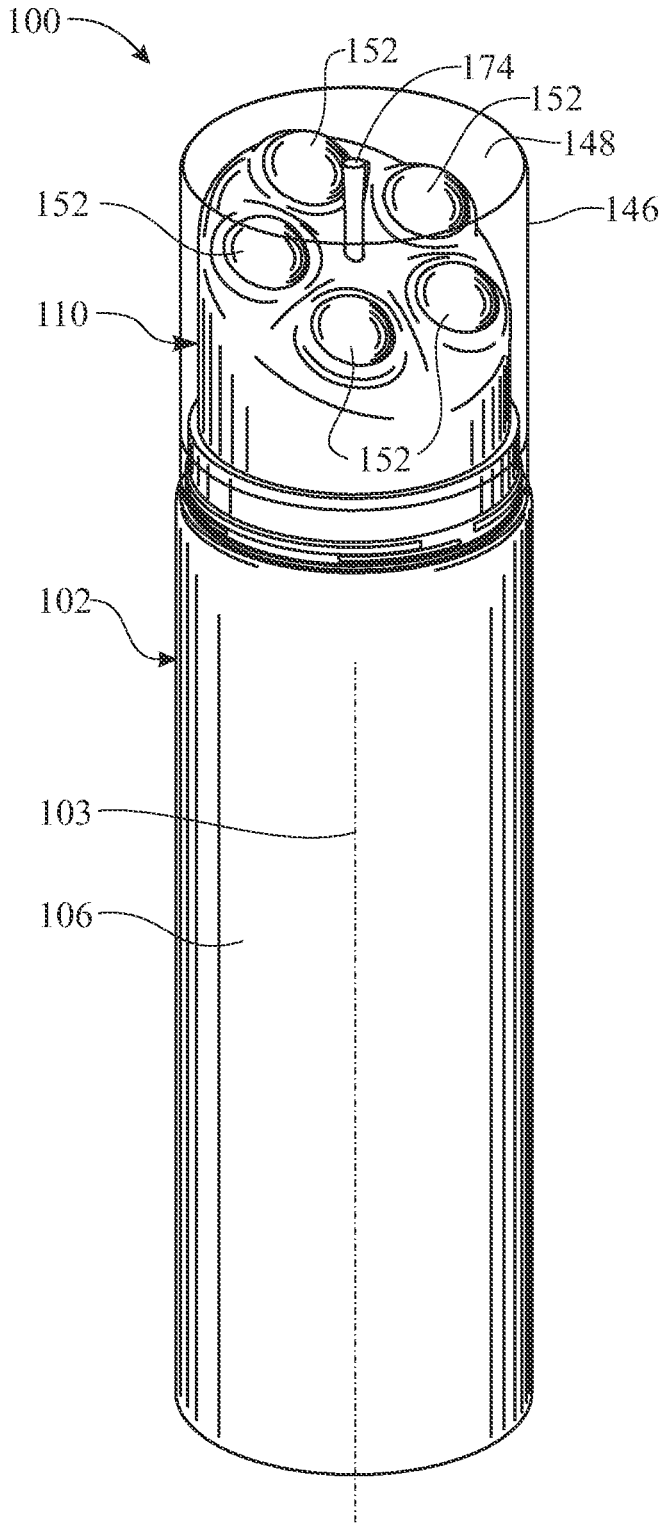
FIG. 1 presents a front perspective view of the liquid dispensing container assembly in accordance with an illustrative embodiment of the present invention.

As illustrated in FIGS. 6 and 7, the dispensing head body 112 may have a dispensing head interior 120. An adaptor cavity 122 may extend upwardly from the dispensing head interior 120 into a center portion of the dispensing head body 112. The dispensing port 126 may establish fluid communication between the adaptor cavity 122 and the dispensing surface 116 of the liquid dispensing head 110. As illustrated in FIG. 1, in some embodiments, a plug 174 or other closure may be inserted into the dispensing port 126 to prevent inadvertent discharge of the liquid substance 182 from the dispensing port 126. A detachable cap 146 may be removably fitted to the container 102 to enclose the liquid dispensing head 110. As illustrated in FIG. 3, at least one rotation stop flange 118 may protrude from the interior surface of the attachment flange 114 to limit the range of rotation of the liquid dispensing head 110 on the container 102.

As further illustrated in FIGS. 6 and 7, a dispensing head wall 128 may extend downwardly from the dispensing head body 112 into the adaptor cavity 122. The dispensing head wall 128 may include a cylindrical, first or inner dispensing head wall portion 130 and a cylindrical, second or outer dispensing head wall portion 132. An annular gap or space 134 may be formed by and between the inner wall portion 130 and the outer wall portion 132. An opening 136 may be provided in the inner wall portion 130 of the dispensing head wall 128 for purposes which will be hereinafter described.

As illustrated in FIGS. 2, 3, 6 and 7, a dispensing adaptor 156 may be disposed in the adaptor cavity 122 of the liquid dispensing head 110 in non-rotatable relationship with respect to the container 102. As shown for instance in FIGS. 2 and 3, the dispensing adaptor 156 may include an adaptor base 158. An adaptor flange 160 may extend radially outward from the adaptor base 158. Furthermore, as shown in FIG. 3, the adaptor base 158 defines and circumferentially encloses a base cavity 159. An adaptor insert 170 may extend downwardly into the base cavity 159 and in concentric relationship to the adaptor base 158, such that an annular gap or space is formed between the adaptor base 158 and the adaptor insert 170. The adaptor insert 170 defines and circumferentially encloses an internal space 171. As best shown in FIG. 2, on a side of the dispensing adaptor 156 opposite to the base cavity 159, the dispensing adaptor 156 further includes a first or inner adaptor wall 164 and a second or outer adaptor wall 162, which may extend upwardly of the adaptor flange 160, and may be generally cylindrical and in concentric relationship to each other. An annular gap or space 168 may be formed by and between the outer adaptor wall 162 and the inner adaptor wall 164. In placement of the liquid dispensing head 110 on the container 102, the adaptor base 158 of the dispensing adaptor 156 may initially be attached to the container neck 140 on the container top 108 of the container 102 by insertion of the adaptor insert 170 in the container neck 140 and engagement of the adaptor base 158 with the neck flange 142 of the container neck 140.

As illustrated in FIGS. 2 and 6, a slit or opening 166 may extend through the inner adaptor wall 164 of the dispensing adaptor 156. A port or opening 172 (FIG. 3) may extend through the adaptor base 158, between the container opening 144 in the container top 108 of the container 102 and the opening 166 in the dispensing adaptor 156, and in fluid communication with the internal space 171 of the adaptor insert 170 and the container opening 144. As illustrated in FIG. 6, the dispensing adaptor 156 and liquid dispensing head 110 are rotatably positioned or assembled relative to one another, with the inner adaptor wall 164 (FIG. 2) of the dispensing adaptor 156 rotatably fitted inside the inner wall portion 130 (FIG. 3) of the liquid dispensing head 110. The liquid dispensing head 110 is rotatable relative to the dispensing adaptor 156 between a dispensing position (FIG. 6) and a closed position (FIG. 7).

In the dispensing position of the liquid dispensing head 110, shown in FIG. 6, the opening 136 in the inner wall portion 130 of the dispensing head wall 128 may align or register with the opening 166 in the inner adaptor wall 164 of the dispensing adaptor 156 to establish fluid communication between the container opening 144 and the opening 166 in the inner adaptor wall 164 of the dispensing adaptor 156. This facilitates flow of the liquid substance 182 from the container interior 104 of the container 102 through the container opening 144 in the container top 108, the opening 172 in the adaptor base 158, the aligned or registering openings 136 and 166, and the dispensing port 126, respectively, onto the dispensing surface 116 of the liquid dispensing head 110.

Conversely, in the closed position of the liquid dispensing head 110, as illustrated in FIG. 7, the opening 136 in the inner wall portion 130 of the dispensing head wall 128 may misalign or misregister with the opening 166 in the inner adaptor wall 164 of the dispensing adaptor 156. In this position of the liquid dispensing head 110 with respect to the dispensing adaptor 156, the inner wall portion 130 of the dispensing head wall 128 blocks the opening 166 in the inner adaptor wall 164 of the dispensing adaptor 156 and prevents flow of the liquid substance 182 from the container interior 104 to the dispensing port 126 and onto the dispensing surface 116 of the liquid dispensing head 110.

As illustrated in FIGS. 2, 6 and 7, in some embodiments, at least one rotation prevention flange 124 may extend upwardly from the container top 108 of the container 102. The rotation prevention flanges 124 may engage the adaptor base 158 of the dispensing adaptor 156 to prevent rotation of the dispensing adaptor 156 with respect to the container 102 as the liquid dispensing head 110 is rotated with respect to the dispensing adaptor 156 and the container 102.

Referring next to FIGS. 1-7 of the drawings, in application of the liquid dispensing container assembly 100, a supply of the selected liquid substance 182 may be placed in the container interior 104 of the container 102. In some applications, the liquid substance 182 may be placed in the container interior 104 at the factory according to the knowledge of those skilled in the art. As illustrated in FIGS. 2 and 3, the dispensing adaptor 156 may be placed on the container top 108 of the container 102 with the adaptor base 158 in engagement with the rotation prevention flanges 124 on the container top 108 to prevent rotation of the dispensing adaptor 156 relative to the container 102. As further shown in FIG. 6, the engagement between the dispensing adaptor 156 and the container 102 may be provided by a clipping between the neck flange 142 of the container neck 140 and an inner side of the adaptor base 158. As further shown in FIG. 6, the radially outwardly protruding flange 160 of the dispensing adaptor 156 may rotationally clip with the liquid dispensing head 110.

As illustrated in FIGS. 2 and 3, the liquid dispensing head 110 may be placed over the dispensing adaptor 156 and the attachment flange 114 on the dispensing head body 112 attached to the container wall 106 of the container 102, such as by threading, snap fitting, friction fitting, or other applicable connection. As illustrated in FIGS. 6 and 7, the dispensing head wall 128 in the adaptor cavity 122 of the liquid dispensing head 110 may insert into the gap or space 168 between the outer adaptor wall 162 and the inner adaptor wall 164 of the dispensing adaptor 156. As illustrated in FIG. 7, the liquid dispensing head 110 may initially be disposed in the closed position on the container 102 such that the opening 136 in the inner wall portion 130 of the dispensing head wall 128 is misaligned or misregisters with the opening 166 in the inner adaptor wall 164 of the dispensing adaptor 156. The inner wall portion 130 of the dispensing head wall 128 thus blocks communication between the opening 166 in the inner adaptor wall 164 of the dispensing adaptor 156 and the port or opening 172 in the dispensing adaptor 156.

As illustrated in FIG. 1, in some embodiments, the plug 174 may be inserted in the dispensing port 126 to prevent inadvertent flow of the liquid substance 182 from the dispensing port 126. The cap 146 may be placed and secured over the liquid dispensing head 110. In some embodiments, as shown, the plug 174 may be comprised in the cap 146 and may protrude inward and downward from an underside of a top wall 148 of the cap 146, such that, by fitting or removing the cap 146 the plug 174 is respectively inserted or removed from the dispensing port 126.

The liquid substance 182 may be dispensed from the container 102 and applied to a surface such as the skin of a user on the arm 180, as illustrated in FIGS. 4 and 5, or other portion of the user's body. Accordingly, the cap 146 may initially be detached from the container 102. The liquid dispensing head 110 may be rotated on the container 102 from the closed position illustrated in FIG. 7 to the open position in FIG. 6. Rotation of the liquid dispensing head 110 may facilitate alignment or registration of the opening 136 in the inner wall portion 130 of the dispensing head wall 128 with the opening 166 in the inner adaptor wall 164 of the dispensing adaptor 156. As illustrated in FIG. 6, this action establishes fluid communication between the container interior 104 of the container 102 and the dispensing port 126 in the dispensing head body 112 of the liquid dispensing head 110 through the container opening 144, the internal space 171 of the adaptor insert 170, the port or opening 172 of the dispensing adaptor 156, the opening 136 in the inner wall portion 130 of the dispensing head wall 128, and the opening 166 in the inner adaptor wall 164 of the dispensing adaptor 156.

As the user applies the massage rollers 152 against the skin, as illustrated in FIGS. 4 and 5, the user may next squeeze the container wall 106 of the container 102 to force a portion of the liquid substance 182 through the container opening 144, opening 172, opening 136, opening 166 and dispensing port 126. The liquid substance 182 is dispensed from the dispensing port 126 and past the dispensing surface 116 onto the skin of the user. Simultaneously, the user may move the massage rollers 152 in a circular or other motion on the skin of the user as the massage rollers 152 simultaneously spread the liquid substance 182 on the skin and massage the skin.

The user can control the quantity of the liquid substance 182 which is dispensed onto the skin by adjusting the rotational position of the liquid dispensing head 110 relative to the dispensing adaptor 156, and thereby adjust the amount of overlapping or alignment between the opening 136 in the inner wall portion 130 of the dispensing head wall 128 and the opening 166 in the inner adaptor wall 164 of the dispensing adaptor 156. Furthermore, the user can stop the liquid substance 182 from being dispensed onto the skin by rotating the liquid dispensing head 110 back to the closed position of FIG. 7. In the closed position, the opening 166 in the dispensing adaptor 156 misaligns or misregisters with the opening 136 in the dispensing head wall 128. Moreover, the user can massage the skin by application of the massage rollers 152 without dispensing the liquid substance 182 from the dispensing port 126. As illustrated in FIG. 1, the plug 174 may be reinserted into the dispensing port 126 to prevent residual liquid substance 182 from inadvertently flowing from the dispensing port 126 onto the dispensing surface 116.

Throughout application, the liquid substance 182 in the container interior 104 of the container 102 may remain out of physical contact with the massage rollers 152 to prevent cross-contamination of the liquid substance 182. Additionally, the massage rollers 152 can be washed and/or disinfected without contacting the liquid substance 182 in the container interior 104. The massage rollers 152 may be fabricated of any of various materials including but not limited to medical grade stainless steel, porcelain, amethyst, plastic, or glass according to the intended use of the liquid dispensing container assembly 100.

It must be noted that the liquid dispensing container assembly of the present disclosure may include organic or non-organic substances such as lotions, gels, creams, shoe-shines, etc. and can be used to apply the liquid substance to correspondingly applicable surfaces on humans, pets, other animals, food, shoes, surfaces such as leather, wood or fabrics, for example and without limitation.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A liquid dispensing container assembly comprising:

a container having a container interior configured to contain a supply of liquid, and a container opening in fluid communication with the container interior;

a dispensing adaptor secured to the container, wherein the dispensing adaptor is fitted over and encloses the container opening, the dispensing adaptor comprising a port in fluid communication with the container opening, the dispensing adaptor further comprising a first adaptor wall and a second adaptor wall arranged radially outward of and in concentric relationship with the first adaptor wall, the first adapter wall comprising a first opening; and a liquid dispensing head carried by the container and comprising a dispensing head interior, a first liquid dispensing head wall portion and a second liquid dispensing head wall portion arranged radially outward of and in concentric relationship with the first liquid dispensing head wall portion, the first liquid dispensing head wall portion comprising a second opening, wherein the liquid dispensing head is positioned over the dispensing adaptor with the dispensing adaptor received in the dispending head interior and the first adaptor wall and first dispensing head wall portion rotationally fitted one into the other, and further with the second adaptor wall and the second liquid dispensing head wall portion rotationally fitted one into the other, the liquid dispensing head further comprising a dispensing side, a dispensing port on the dispensing side, at least one roller socket formed on the dispensing side, and at least one massage roller, wherein each massage roller of the at least one massage roller is disposed in a respective roller socket of the at least one roller socket; wherein the liquid dispensing head is rotatable with respect to the dispensing adaptor, and configured to rotationally adopt a dispensing position in which the second opening aligns with the first opening, and fluid communication is provided from the container interior, through the container opening, through the port of the dispensing adaptor, through the aligned first and second openings, and to the dispensing port of the liquid dispensing head.

2. The liquid dispensing container assembly of claim 1, wherein the liquid dispensing head is configured to further rotationally adopt a closed position in which the second opening is not aligned with the first opening, preventing fluid communication from the port of the dispensing adaptor to the dispensing port of the liquid dispensing head.

3. The liquid dispensing container assembly of claim 1, wherein the first adaptor wall and the first liquid dispensing head wall portion are cylindrical.

4. The liquid dispensing container assembly of claim 3, wherein the first adaptor wall and the first liquid dispensing head wall portion are arranged in concentric relationship with one another.

5. The liquid dispensing container assembly of claim 4, wherein the first liquid dispensing head wall portion is arranged radially outward of the first adaptor wall.

6. The liquid dispensing container assembly of claim 1, wherein the first and second adaptor walls and the first and second liquid dispensing head wall portions are cylindrical.

7. The liquid dispensing container assembly of claim 6, wherein the second liquid dispensing head wall portion is arranged radially inward of the second adaptor wall.

8. The liquid dispensing container assembly of claim 1, wherein the at least one roller socket comprises a plurality of roller sockets, and the at least one massage roller comprises a corresponding plurality of massage rollers.

9. The liquid dispensing container assembly of claim 8, wherein the plurality of massage rollers are arranged radially outward of the dispensing port.

10. The liquid dispensing container assembly of claim 9, wherein the plurality of massage rollers are disposed around the dispensing port.

11. The liquid dispensing container assembly of claim 8, wherein respective outer sides of the plurality of massage rollers are arranged along an imaginary surface forming an angle other than 90 degrees with a longitudinal axis of the container.

12. The liquid dispensing container assembly of claim 8, wherein the dispensing side forms an angle other than 90 degrees with a longitudinal axis of the container.

13. The liquid dispensing container assembly of claim 1, wherein the dispensing adaptor comprises a radially outwardly protruding flange configured to rotationally clip onto the liquid dispensing head within the liquid dispensing head interior.

14. The liquid dispensing container assembly of claim 1, wherein the container further comprises a container neck arranged around the container opening, and further wherein the dispensing adaptor comprises an adaptor base, wherein the adaptor base is clipped to the container neck.

15. The liquid dispensing container assembly of claim 14, wherein the adaptor base is arranged radially outward of and in concentric relationship with the container neck.

16. The liquid dispensing container assembly of claim 15, wherein the adaptor base further comprises an adaptor insert fitted inside the container neck, the adaptor insert and container neck enclosing the container opening to direct fluid from the container opening to the dispensing adaptor.

17. The liquid dispensing container assembly of claim 1, wherein the container comprises at least one rotation prevention flange configured to limit rotation of the dispensing adaptor.

18. A liquid dispensing container assembly comprising:

a container having a container interior configured to contain a supply of liquid, and a container opening in fluid communication with the container interior;

a dispensing adaptor secured to the container, wherein the dispensing adaptor is fitted over and encloses the container opening, the dispensing adaptor comprising a port in fluid communication with the container opening, the dispensing adaptor further comprising a first adaptor wall and a second adaptor wall arranged radially outward of and in concentric relationship with the first adaptor wall, the first adapter wall comprising a first opening; and a liquid dispensing head carried by the container and comprising a dispensing head interior, a first liquid dispensing head wall portion and a second liquid dispensing head wall portion arranged radially outward of and in concentric relationship with the first liquid dispensing head wall portion, the first liquid dispensing head wall portion comprising a second opening, wherein the liquid dispensing head is positioned over the dispensing adaptor with the dispensing adaptor received in the dispending head interior and the first adaptor wall and first dispensing head wall portion rotationally fitted one into the other, and further with the second adaptor wall and the second liquid dispensing head wall portion rotationally fitted one into the other, the liquid dispensing head further comprising a dispensing side, a dispensing port on the dispensing side, at least one roller socket formed on the dispensing side, and at least one massage roller, wherein each massage roller of the at least one massage roller is disposed in a respective roller socket of the at least one roller socket; wherein the liquid dispensing head is rotatable with respect to the dispensing adaptor, and configured to rotationally adopt:

a dispensing position in which the second opening aligns with the first opening, and fluid communication is provided from the container interior, through the container opening, through the port of the dispensing adaptor, through the aligned first and second openings, and to the dispensing port of the liquid dispensing head, and a closed position in which the second opening is not aligned with the first opening, preventing fluid communication from the port of the dispensing adaptor to the dispensing port of the liquid dispensing head.

19. A liquid dispensing container assembly comprising:

a container having a container interior configured to contain a supply of liquid, and a container opening in fluid communication with the container interior;

a dispensing adaptor secured to the container, wherein the dispensing adaptor is fitted over and encloses the container opening, the dispensing adaptor comprising a port in fluid communication with the container opening, the dispensing adaptor further comprising a cylindrical, first adaptor wall and a second adaptor wall arranged radially outward of and in concentric relationship with the first adaptor wall, the first adapter wall comprising a first opening; and a liquid dispensing head carried by the container and comprising a dispensing head interior, a cylindrical, first liquid dispensing head wall portion and a second liquid dispensing head wall portion arranged radially outward of and in concentric relationship with the first liquid dispensing head wall portion, the first liquid dispensing head wall portion arranged in concentric relationship with and radially outward of the first adaptor wall and comprising a second opening, wherein the liquid dispensing head is positioned over the dispensing adaptor with the dispensing adaptor received in the dispending head interior and the first adaptor wall and first dispensing head wall portion rotationally fitted one into the other, and further with the second adaptor wall and the second liquid dispensing head wall portion rotationally fitted one into the other, the liquid dispensing head further comprising a dispensing side, a dispensing port on the dispensing side, at least one roller socket formed on the dispensing side, and at least one massage roller, wherein each massage roller of the at least one massage roller is disposed in a respective roller socket of the at least one roller socket; wherein the liquid dispensing head is rotatable with respect to the dispensing adaptor, and configured to rotationally adopt:

a dispensing position in which the second opening aligns with the first opening, and fluid communication is provided from the container interior, through the container opening, through the port of the dispensing adaptor, through the aligned first and second openings, and to the dispensing port of the liquid dispensing head, and a closed position in which the second opening is not aligned with the first opening, preventing fluid communication from the port of the dispensing adaptor to the dispensing port of the liquid dispensing head.

* * * * *